US010464735B2

(12) United States Patent
Schroer et al.

(10) Patent No.: US 10,464,735 B2
(45) Date of Patent: Nov. 5, 2019

(54) CAP WITH NESTED HANDLE FOR SPRAY CAN

(71) Applicant: Dow Global Technologies LLC, Midland, MI (US)

(72) Inventors: Daniel R. Schroer, Saginaw, MI (US); Marc S. Black, Midland, MI (US); Chad V. Schuette, Freeland, MI (US); Christopher J. Siler, Hemlock, MI (US)

(73) Assignee: DOW GLOBAL TECHNOLOGIES LLC, Midland, MI (US)

( * ) Notice: Subject to any disclaimer, the term of this patent is extended or adjusted under 35 U.S.C. 154(b) by 0 days.

(21) Appl. No.: 15/758,741

(22) PCT Filed: Oct. 19, 2016

(86) PCT No.: PCT/US2016/057633

§ 371 (c)(1),
(2) Date: Mar. 9, 2018

(87) PCT Pub. No.: WO2017/074756

PCT Pub. Date: May 4, 2017

(65) Prior Publication Data

US 2019/0031426 A1 Jan. 31, 2019

Related U.S. Application Data

(60) Provisional application No. 62/246,771, filed on Oct. 27, 2015.

(51) Int. Cl.

| | |
|---|---|
| ***B65D 83/20*** | (2006.01) |
| ***B65D 83/30*** | (2006.01) |
| ***B65D 83/40*** | (2006.01) |
| ***B65D 83/46*** | (2006.01) |

(52) U.S. Cl.

CPC ..... *B65D 83/202* (2013.01); *B65D 83/303* (2013.01); *B65D 83/40* (2013.01); *B65D 83/46* (2013.01)

(58) Field of Classification Search

CPC .... B65D 83/202; B65D 83/303; B65D 83/40; B65D 83/46

USPC ..... 222/402.13

See application file for complete search history.

(56) References Cited

U.S. PATENT DOCUMENTS

| | | | | | |
|---|---|---|---|---|---|
| 4,353,483 | A | * | 10/1982 | Pehr | B65D 83/40 215/216 |
| 4,858,792 | A | * | 8/1989 | de Laforcade | B65D 83/205 222/533 |
| 5,850,952 | A | * | 12/1998 | Morck | B65D 83/303 222/530 |
| 5,992,707 | A | | 11/1999 | Gaichuk | |

(Continued)

FOREIGN PATENT DOCUMENTS

| | | |
|---|---|---|
| DE | 8111028 | 9/1981 |
| DE | 3743896 | 7/1989 |

*Primary Examiner* — Jeremy Carroll

(74) *Attorney, Agent, or Firm* — Andrew Bunn

(57) ABSTRACT

An article including a cap (10) for a can (100), the article including: (a) a first section (20), where the first section fits over the top (110) of the can and attaches to the can; and (b) a second section (30) that is movably attached to the first section so that it is movable from a closed position generally above the top of the first section to an open position generally alongside the first section.

7 Claims, 5 Drawing Sheets

(56) References Cited

U.S. PATENT DOCUMENTS

| | | | | |
|---|---|---|---|---|
| 6,325,256 | B1 | 12/2001 | Liljeqvist et al. | |
| 6,874,663 | B2 * | 4/2005 | Scheindel | B65D 83/201 222/153.12 |
| 7,000,805 | B1 | 2/2006 | Wu et al. | |
| 2006/0255077 | A1 | 11/2006 | Sugano et al. | |
| 2013/0320045 | A1 * | 12/2013 | Hoagland | B05B 1/3046 222/402.13 |
| 2013/0334260 | A1 | 12/2013 | Hermans et al. | |
| 2016/0001962 | A1 * | 1/2016 | Lee | B65D 83/28 222/402.15 |
| 2016/0075503 | A1 | 3/2016 | Ramsey et al. | |

* cited by examiner

CAP WITH NESTED HANDLE FOR SPRAY CAN

BACKGROUND OF THE INVENTION

Field of the Invention

The present invention relates to a cap that incorporates a handle for spray cans.

Introduction

Dispensing material from a pressurized can, such as with polyurethane foam sealants, frothed latex foam sealants and foam dessert topping, often requires holding the can at awkward angles while tilting a valve stem to release the contents from the can through the value stem.

There are caps available with handles for use with pressurized cans to facilitate more comfortable dispensing.

U.S. Pat. No. 7,000,805 discloses a polyurethane foam rubber fluid applicator. A can of foam rubber composition fits upside-down into the applicator. The applicator comprises a handle that facilitates holding the can and a trigger for initiating dispensing of the foam rubber formulation from the can. When dispensing, the trigger is pulled and the valve on the can is displaced up towards the can to release foam formulation from the can. The applicator is an add-on applicator, meaning that it is attached to a can for the purpose of dispensing from the can. The can would not likely be shipped with the applicator attached to the can because the handle extending out from the can prevents compact and efficient packaging and storage, the exposed trigger risks accidental dispensing of the can, and there is minimal if any protection of the can valve stem to prevent damage or accidental dispensing.

US2013/0334260 ('260) offers an applicator that has a handle extending vertically (generally longitudinally to the can length) above the top of a can and a dispensing straw that flips up from along the length of the can through which dispensing of the contents of the can occurs. The design of '260 requires holding the can generally perpendicular to one's forearm, which tends to be uncomfortable over time and significantly limits the maneuverability of the can into tight, hard to reach locations.

It is desirable to develop a cap for pressurized cans that allows the can to be packed closely and efficiently during storage and shipping with the cap on the can and yet converts to a handle for comfortably holding the can generally longitudinally to one's forearm when dispensing the contents of the can. Such a cap would obviate a need for separate cap and applicator for a can.

BRIEF SUMMARY OF THE INVENTION

The present invention provides a cap for pressurized cans that allows the can to be packed closely and efficiently during storage and shipping with the cap on the can and yet provides for comfortably holding the can generally longitudinally to one's forearm when dispensing the contents of the can.

The present invention offers a solution to this challenge by providing a cap that fits on a can and remains compactly over the can when not in use but is able to, without removing it from the can, be opened to an orientation providing a handle to hold the can generally longitudinally to one's forearm while dispensing from the can.

The present invention further advances the art by incorporating a handle into the cap of a pressurized can thereby enabling a single feature to both provide protection of the valve stem of the can when not in use and holding of the can when in use. The need for a dedicated cap and separate handle is simplified by incorporated both features into a single transformable feature.

In a first aspect, the present invention is an article comprising a cap (10) and a can (100), wherein the can comprises a top (110) and a valve stem (120) extending out from the top of the can and wherein the cap comprises: (a) a first section (20), where the first section fits at least partially around the top of the can and attaches to the can; and (b) a second section (30) that is movably attached to the first section so that it is movable from a closed position generally above the top of the can and covering the valve stem of the can to an open position generally alongside the first section such that when the cap is in the open position the valve stem of the can extends above the first section of the cap and is accessible above the cap with barrier-free access above and all the way around the circumference of the first section of the cap.

The article of the present invention is useful for protecting the valve stem of a can while shipping and storing while also being useful for holding the can while dispensing the contents of the can, including foam sealants (such as polyurethane foam sealants and frothed latex foam sealants) as well as foam dessert topping.

DETAILED DESCRIPTION OF THE INVENTION

Figure 1A:
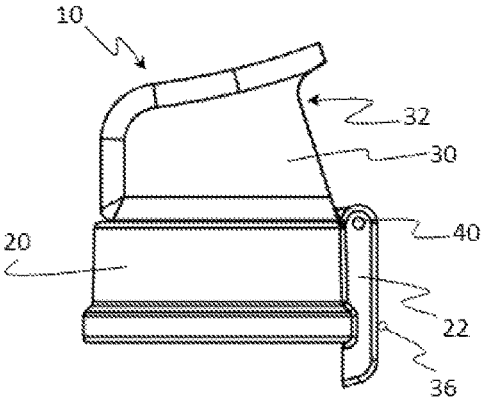
FIGS. 1(*a*)-1(*f*) illustrate a cap of the present invention where first and second sections of the cap are attached by a hinge.
Figure 1B:
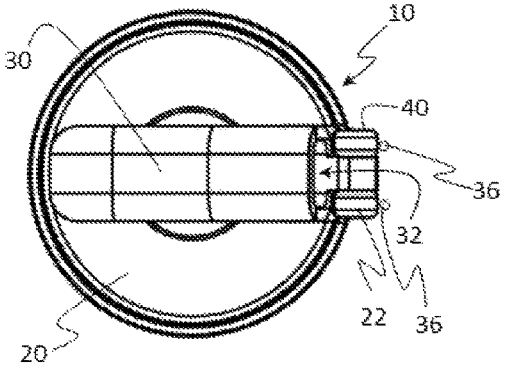
Figure 1C:
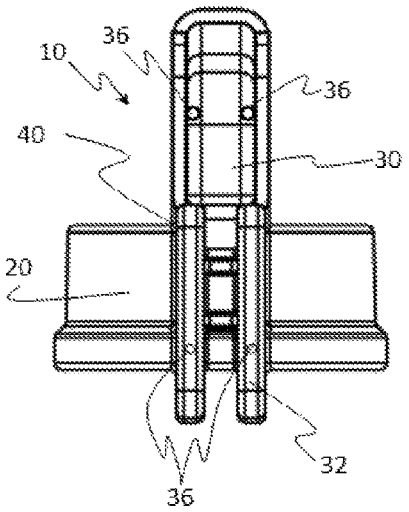
Figure 1D:
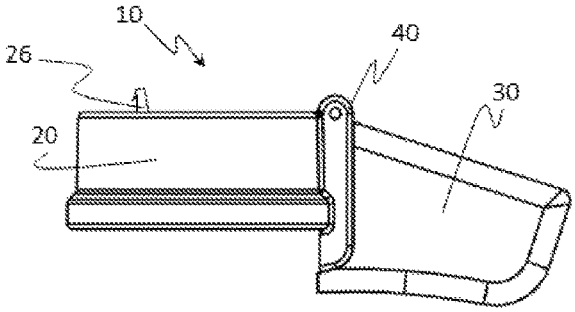
Figure 1E:
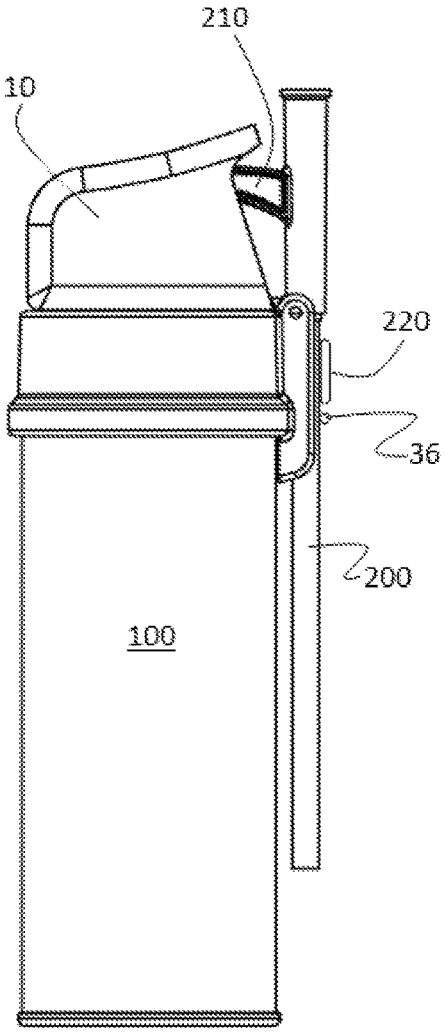
Figure 1F:
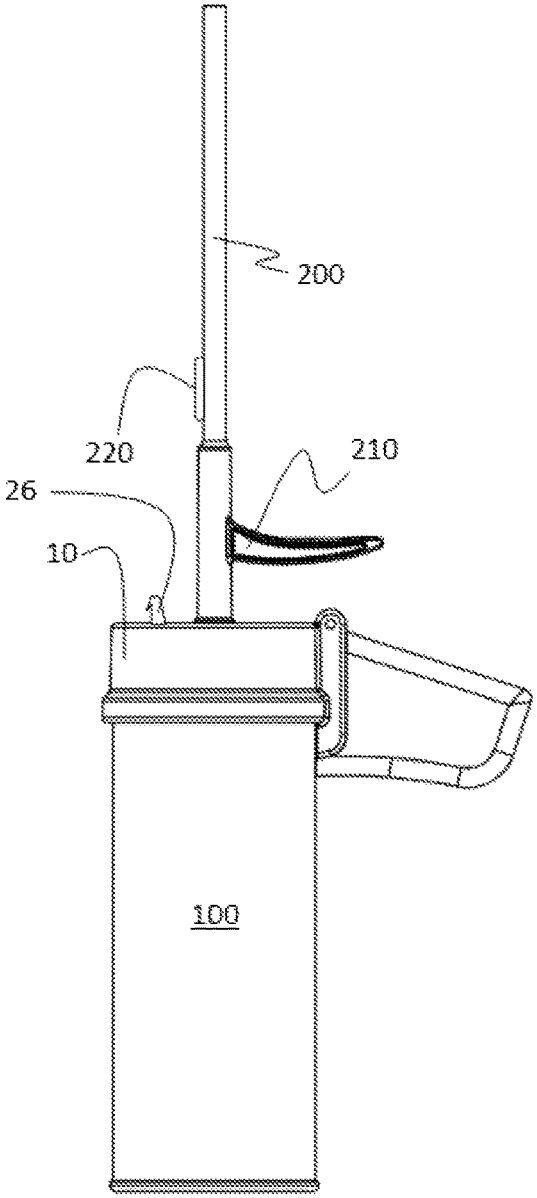
Figure 2A:
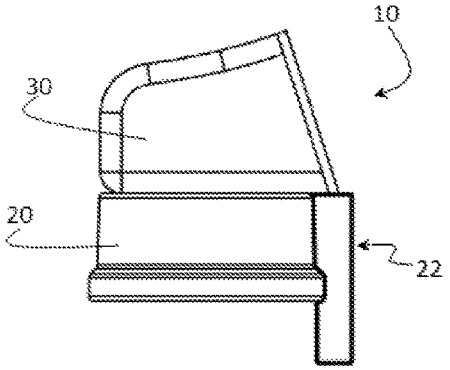
FIGS. 2(*a*)-2(*f*) illustrate a cap of the present invention where first and second sections of the cap are attached by ridges in one section sliding into grooves of the other section.
Figure 2B:
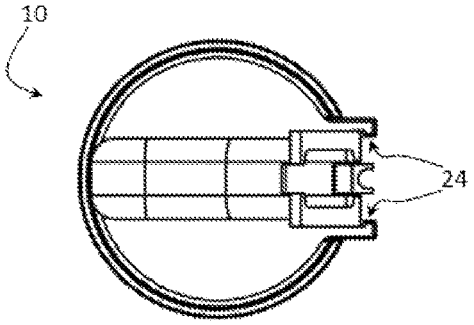
Figure 2C:
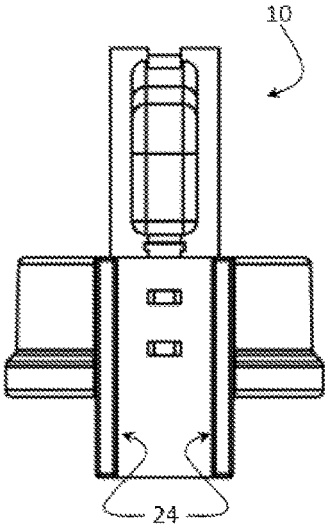
Figure 2D:
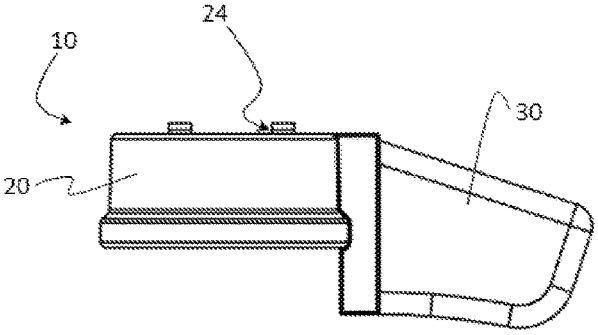
Figure 2E:
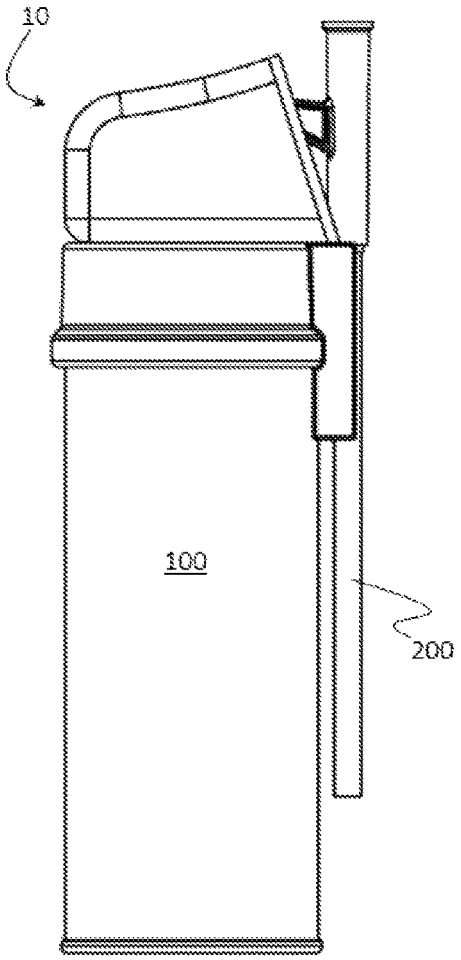
Figure 2F:
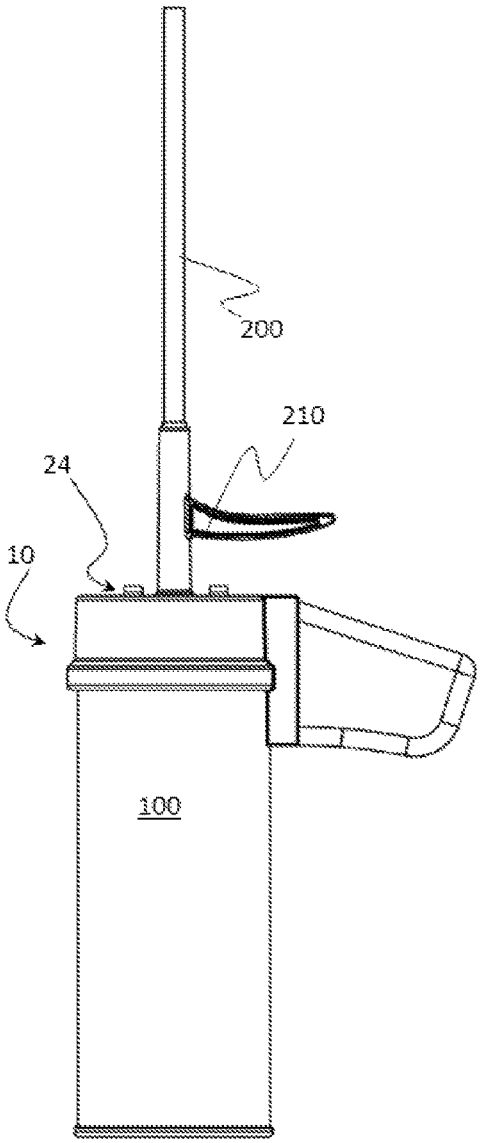

"And/or" means "and, or alternatively". All ranges include endpoints unless otherwise stated.

"Generally" means that the characterization does not have to be exact but allows for reasonable tolerances to one of ordinary skill in the art. For example an element that extends "generally perpendicular" to a reference means the element can extend 90 degrees from the reference, but also allows for a broader understanding than extending precisely 90 degrees from the reference. In a broadest reasonable reading, "generally perpendicular" means extending in a direction that has a vector component in a direction perpendicular to a reference, preferably extending at least 45 degrees relative to the reference and more preferably extending at least 60 degrees from the reference and can mean extending 90 degrees from a reference. "Generally above" and "generally over" mean having at least a portion residing over a reference, preferably having more than 50 volume-percent (vol %) residing over a reference, more preferably at least 75 vol % residing over a reference and can mean having 90 vol % or more residing over a reference.

The article of the present invention comprises a cap for a can. Desirably, the can is a container that can hold pressurized material, generally pressurized liquid material. The can has a top and, typically, an opposing bottom. The dimension between the top and bottom of the can is the length of the can. The can comprises a valve stem extending out of the top of the can through which material can be dispensed from the can. When the valve stem is activated by being pressed into the can or tilted with respect to the can it opens a valve and material inside the can is released to dispense through the valve stem. One reason for having a cap for the can is to protect the valve stem during shipping and storage to prevent unintentional dispensing of material from the can. The cap serves to cover the valve stem when the can is not being used to intentionally dispense material.

The cap comprises a first section and a second section. The first section fits at least partially and generally completely around the top of the can and attaches to the can. The first section can fit over the top of the can. Typically, the top of the can will have a rim around it to which or around which the first section of the cap can attach by, for example, snapping the rim into a groove in the first section of the cap. The first section can be attached to the can by frictional forces, such as by snapping a rim around the top of the can into a groove in the first section of the cap or, as another example, by just sliding the cap like a sleeve over the top of the can and along the sides of the can with enough frictional force to hold into place. The first section may be affixed to the can using an adhesive.

The first section of the cap leaves the valve stem of the can accessible. When the cap is in the open position as described below, the valve stem of the can extends above the first section of the cap and is accessible above the cap with barrier-free access above and all the way around the circumference of the first section of the cap. The first section of the cap may extend up at least part of the height of the valve stem above the can. However, the valve stem is accessible over the first section of the cap to enable dispensing of material from the can without having to remove the first section of the cap from the can.

The second section of the cap is movably attached to the first section of the cap. "Movably attached" means that the second section can move with respect to the first section while remaining attached to the first section. For example, the second section can be attached to the first section by means of a hinge. Alternatively, the second section can have either grooves or ridges that mate into either ridges or grooves, respectively, of the first section so that the ridges of one section can slide in the grooves of the other section. In such an "alternative" embodiment, the second section can be capable of sliding completely off from (detaching from) the first section and slid onto the first section so as to be movably attached to the first section in a different location. The second section can alternatively be capable of sliding over and then down the side of the first section without coming unattached from the first section.

The second section is capable of moving, desirably reversibly moving, between a closed position and an open position with respect to the first section. When in the closed position, the second section resides generally above the top of the first section, which means the second section resides over the first section of the cap so that at least a portion of the first section resides between the second section of the cap and a can onto which the first section is placed. When the second section is in the closed position and the cap is on a can, the second section extends around the sides of the valve stem of the can and desirably covers the valve stem of the can thereby protecting the valve stem from accidental activation or damage. The first and second sections can include a retaining mechanism such as a snap closure that holds the first and second section into a closed position until a user actively moves the second section into an open position. One example of a suitable retaining mechanism is a flexible tab extending from one section that snaps into a groove or slot of the other section or a pin on one section that snaps into a hole on the other section. Another acceptable retaining mechanism is friction between the two sections, such as at a hinge joint if they are hingedly connected and/or by having the second section slide into or over a portion of the first section with sufficient friction to hold the second section in place over the first section.

The second section is movable from the closed position to an open position that exposes the valve stem of the can and makes the valve stem accessible for dispensing the contents of the can. When the cap is in the open position, the valve stem of the can extends above the first section of the cap and is accessible above the cap with barrier-free access above and all the way around the circumference of the first section of the cap, rending the valve stem accessible while the first section of the cap remains on the can. The second section of the cap moves with respect to the first section of the cap so as to become positioned adjacent to the first section of the cap when in the open position. For example, the second section can flip over the first section via a hinged joint and align next to the first section. As an alternative example, the second section can slide across the first section and then slide down next to the first section by means of ridges of one section sliding in grooves of the other section. The second section can slide all the way off from the first section and then be slid back onto the first section in the new orientation or, alternatively, the second section can slide to the edge of the first section and, without dislocating entirely from the first section, slide down grooves on the side of the first section to a new location. It is desirable for the second section to move from generally above the first section when in the closed position to generally next to the first section when in the open position. When moving in such a manner when the cap is on a can, the second section moves from being generally above the can to generally next to the can and extending generally perpendicular to the length of the can.

Desirably, when the second section of the cap is in the open position the cap has a holding mechanism that holds the first and second sections of the cap in the open position. The holding mechanism can be a mechanical clip, a tab on one section that snaps into or onto the other section or any other holding mechanism.

An advantage of the present invention is that that the second section of the cap serves as a handle for holding the can while dispensing the can contents when the cap is in the open position and further serves to cover the valve stem when the cap is in the closed position. When in the open position, use of the second section as a handle allows for holding the can generally aligned with the forearm of the person dispensing from the can, which is a more comfortable orientation than holding the can generally perpendicular to the forearm of the person dispensing from the can. Aligning the can next to and along the forearm allows for improved maneuverability and access to difficult to reach (for example, tight fitting or crowded) locations. Moreover, the cap of the present invention allows for compact packaging and storage of cans comprising the cap because the cap, in the closed position, is aligned generally over the can. Yet, when the can is used the cap converts to a convenient handle extending generally perpendicular to the can's length for holding the can in a comfortable orientation aligned generally along the user's forearm.

The article of the present invention may further comprise a dispensing straw. Generally, a dispensing straw is attached to the valve stem of a can through which the contents of the can are dispensed in a directed manner. Such a dispensing straw is attachable to the valve stem of the can, usually by means of a connector on one end of the dispensing straw that attaches to the valve stem of the can. The dispensing straw also desirably comprises a lever or trigger and/or a finger pad to facilitate dispensing contents of a can. A lever or trigger typically extends generally perpendicular to the straw while a finger pad is generally in the form of a flattened platform on the dispensing straw against which a finger can be pressed. When the dispensing straw is attached to the valve stem of a can the valve stem can be activated by pulling or pressing the trigger or lever and/or by pressing the finger pad on the dispensing straw.

The cap of the present invention may further comprise a dispensing straw holder that conveniently holds a dispensing straw in a space-efficient manner extending generally along the length of the can when not in use so as to allow for efficient special packing and storing of cans comprising the cap and dispensing straw and storage of the dispensing straw when not in use to avoid loss of the dispensing straw. The first and/or second section of the cap may comprise a dispensing straw holder that may be, for example, in the form of a clip or a hole or groove defined in the first and/or second section of the cap into which a dispensing straw can be placed oriented generally along the length of the can. Moreover, the cap can comprise a recess, generally in the second section, that allows the trigger or lever of the dispensing straw to fit within the cap when the dispensing straw is stored in the dispensing straw holder of the cap.

The dispensing straw holder typically extends to the side of the top of the can when the cap is position on the top of a can so that when the dispensing straw is positioned in the dispensing straw holder the dispensing straw extends along the length of the can.

Figure 3:
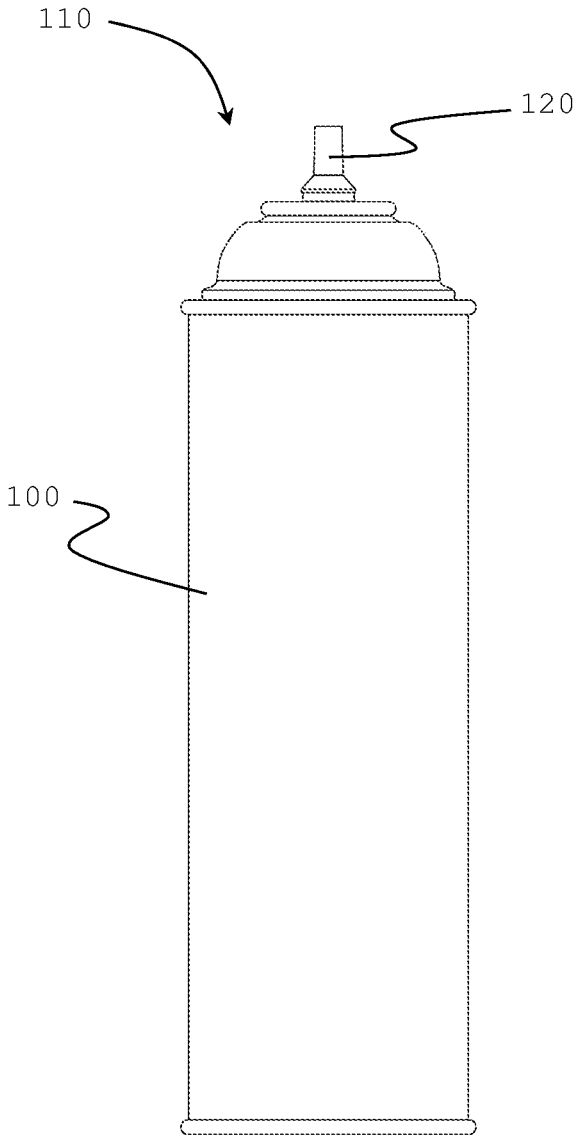
FIG. 3 illustrates a can suitable for use with the present invention.

FIGS. 1(*a*) through 1(*f*) illustrate one embodiment of cap 10. FIG. 3 illustrates can 100 suitable for use with cap 10. Cap 10 comprises first section 20 and second section 30. Second section 30 is attached to first section 20 by means of hinge 40. FIGS. 1(*a*) 1(*c*) illustrate cap 10 the closed position from different perspectives. FIG. 1(*a*) is a side view, 1(*b*) is a top view, and 1(*c*) is an end view. FIG. 1(*d*) illustrates cap 10 in an open position. FIGS. 1(*e*) and 1(*f*) illustrate cap 10 on can 100. Cap 10 is attached over the top 110 (see FIG. 3) of can 100. Extending through the top 110 of can 100 is valve stem 120 (see FIG. 3, hidden by cap 10 in FIG. 1(*e*) and covered by straw 200 in FIG. 1(*f*)). FIG. 1(*e*) illustrates cap 10 in the closed position and FIG. 1(*f*) illustrates cap 10 in the open position. When cap 10 is in the closed position valve stem 120 is protected by the second section 30 of cap 10. When cap 10 is in the open position, valve stem 120 is revealed and accessible for attaching dispensing straw 200. Dispensing straw 200 comprises lever or trigger 210 and finger pad 220. When cap 10 is closed, dispensing straw 200 can be stored in holder 22 in the form of a groove defined in and extending through first section 20 of cap 10 into which straw 200 can snap into place and lever or trigger 210 can extend into recess 32 of second section 30 of cap 10. Retaining mechanism 26 is in the form of a clip that latches the second section 30 into the closed position. Holding mechanism 36 comprises protrusions attached to the first section 20 and holes into which the protrusions insert when cap 10 is in the open position to hold cap 10 in the open position.

FIGS. 2(*a*) through 2(*f*) illustrate another example of cap 10. FIGS. 2(*a*) 1(*c*) illustrate cap 10 the closed position from different perspectives. FIG. 2(*a*) is a side view, 2(*b*) is a top view, and 2(*c*) is an end view. FIG. 2(*d*) illustrates cap 10 in an open position. FIGS. 2(*e*) and 2(*f*) illustrate cap 10 on can 100. Cap 10 of FIGS. 2(*a*) 2(*f*) is similar to that of FIGS. 1(*a*) 1(*f*) except it does not have hinge 40 and instead the second section 30 of cap 10 attaches to first section 20 of cap 10 by means of ridges 34 (not visible) of second section 30 that slide in grooves 24 of first section 20. To move cap 10 from the closed position of FIG. 2(*a*) to the open position of 2(*d*), slide second section 30 off from the top of first section 20 and then slide ridges 34 on the side of second section 30 into grooves 24 on the side of first section 20 (see FIGS. 2(*b*) and 2(*c*)). To return cap 10 to the closed position, slide second section 30 off from the side of first section 20 and then slide ridges 34 (not visible) on the bottom of second section 30 into grooves 24 on top of first section 20 (see FIG. 2(*d*)). For cap 10 of either example, when moving cap 10 from closed position to open position, make sure dispensing straw 200 is not in holder 22 and when moving cap 10 from the open position to the closed position make sure that dispensing straw 200 is not attached to valve stem 120.

What is claimed is:

1. An article comprising a cap (10) and a can (100), wherein the can comprises a top (110) and a valve stem (120) extending out from the top of the can and wherein the cap comprises: (a) a first section (20), where the first section fits at least partially around the top of the can and attaches to the can; and (b) a second section (30) that is movably attached to the first section so that it is movable from a closed position having at least a portion of the second section above the top of the can and covering and extending around the sides of the valve stem of the can to an open position alongside the first section such that when the cap is in the open position the valve stem of the can extends above the first section of the cap and is accessible above the cap with barrier-free access above and all the way around the circumference of the first section of the cap; and wherein the first section and second section of the cap have a holding mechanism (36) that enables the second section to be held into place with respect to the first section and the second section serves as a handle for holding the can when in the open position.

2. The article of claim 1, wherein the second section is attached to the first section by a means selected from a group consisting of: (i) a hinge (40) that allows the second section to swing from the closed position to the open position; and (ii) mating grooves (24) and ridges (34) that enable the second section to slide along the top of the first section and then slide down alongside the first section.

3. The article of claim 1, wherein the article further comprises dispensing straw (200) that is attachable to the valve stem of the can when the cap is in the open position and wherein there is a holder (22) defined in at least one of the first and second sections into which the dispensing straw can reside for storage when the cap is in the closed position.

4. The article of claim 3, wherein the dispensing straw further comprises at least one of trigger (210) extending in a direction that has a vector component in a direction perpendicular to the dispensing straw and a finger pad (220) on the side of the dispensing straw.

5. The article of claim 4, wherein there is an absence of a trigger attached to the valve stem when the straw is not attached to the valve stem.

6. The article of claim 4, wherein there is an absence of barriers around the lever and/or finger pad of the dispensing straw when the dispensing straw is attached to the valve stem.

7. The article of claim 1, wherein the first section and second section of the cap have a retaining mechanism (26) that is a snap closure and that enables the second section to be held into place with respect to the first section when in the closed position.

* * * * *